US007251429B2

(12) United States Patent
Nakafuji et al.

(10) Patent No.: US 7,251,429 B2
(45) **Date of Patent: *Jul. 31, 2007**

(54) IMAGE FORMING APPARATUS WITH AN ENERGY STORAGE THAT CAN BE DISCHARGED, AND WITH A DISPLAY OF RESIDUAL ENERGY IN THE STORAGE

(75) Inventors: Atsushi Nakafuji, Tokyo (JP); Shigeo Kurotaka, Kanagawa (JP); Katsuhiro Echigo, Saitama (JP); Takashi Fujita, Tokyo (JP); Hisashi Kikuchi, Kanagawa (JP); Jun Yura, Kanagawa (JP); Toshihiko Baba, Chiba (JP); Hirokazu Ikenoue, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/437,655

(22) Filed: May 22, 2006

(65) Prior Publication Data

US 2006/0210298 A1 Sep. 21, 2006

Related U.S. Application Data

(63) Continuation of application No. 11/025,985, filed on Jan. 3, 2005, now Pat. No. 7,058,330, which is a continuation of application No. 10/302,902, filed on Nov. 25, 2002, now Pat. No. 6,847,792.

(30) Foreign Application Priority Data

Nov. 26, 2001 (JP) ..... 2001-358933

(51) Int. Cl.
*G03G 15/00* (2006.01)
*G03G 15/20* (2006.01)

(52) U.S. Cl. ..... 399/69; 219/216; 399/81; 399/88

(58) Field of Classification Search ..... 399/69, 399/33, 88, 70, 67, 37, 8, 9, 320, 81; 219/216; 347/156

See application file for complete search history.

(56) References Cited

U.S. PATENT DOCUMENTS

| | | | | |
|---|---|---|---|---|
| 3,692,401 | A | 9/1972 | Kawai | 399/411 |
| 6,233,408 | B1 * | 5/2001 | Allen | 399/8 |
| 6,542,705 | B2 | 4/2003 | Fujita et al. | 399/69 |
| 6,741,226 | B2 * | 5/2004 | Shirasawa | 345/60 |

(Continued)

FOREIGN PATENT DOCUMENTS

| | | |
|---|---|---|
| JP | 3-36579 | 2/1991 |

(Continued)

*Primary Examiner*—Sophia S. Chen
(74) *Attorney, Agent, or Firm*—Oblon, Spivak, McClelland, Maier & Neustadt, P.C.

(57) ABSTRACT

An image forming apparatus of the present invention includes a fixing device for fixing a toner image formed on a recording medium. A heat source is applied with power for generating heat to thereby heating the heating device. A drive circuit includes a storage capable of being selectively charged or discharged and a charger for charging the storage by being supplied with power from a commercial power supply. A discharging device discharges the storage in a non-use mode in which the apparatus is not used.

19 Claims, 5 Drawing Sheets

U.S. PATENT DOCUMENTS

| | | | | |
|---|---|---|---|---|
| 6,847,792 | B2 | 1/2005 | Nakafuji et al. | 399/69 |
| 7,058,330 | B2 * | 6/2006 | Nakafuji et al. | 399/69 |
| 2002/0043523 | A1 | 4/2002 | Fujita et al. | 219/216 |

FOREIGN PATENT DOCUMENTS

| | | | |
|---|---|---|---|
| JP | 05-336737 | A * | 5/1992 |
| JP | 7-333751 | | 12/1995 |
| JP | 08-056998 | A * | 3/1996 |
| JP | 2000-98682 | | 4/2000 |
| JP | 2001-143891 | | 5/2001 |
| JP | 2001-255793 | | 9/2001 |
| JP | 2002-280146 | | 9/2002 |
| JP | 2002-311751 | | 10/2002 |

* cited by examiner

IMAGE FORMING APPARATUS WITH AN ENERGY STORAGE THAT CAN BE DISCHARGED, AND WITH A DISPLAY OF RESIDUAL ENERGY IN THE STORAGE

CROSS-REFERENCE TO RELATED APPLICATIONS

The present application is a continuation of U.S. application Ser. No. 11/025,985 filed on Jan. 3, 2005, now U.S. Pat. No. 7,058,330 which is a continuation of U.S. application Ser. No. 10/302,902 filed Nov. 25, 2002, now U.S. Pat. No. 6,847,792 and in turn claims priority to JP 2001-358933 filed on Nov. 26, 2001, the entire contents of each of which are hereby incorporated herein by reference.

BACKGROUND OF THE INVENTION

1. Field of the Invention

The present invention relates to a copier, printer, facsimile apparatus or similar image forming apparatus capable of insuring user's safety when the apparatus is not used.

2. Description of the Background Art

It is a common practice with an image forming apparatus to use a fixing device of the type having a heat roller heated by a heat source and a press roller pressed against the heat roller. In this type of heating device, while the heat roller being heated is in rotation, a sheet or recording medium carrying a toner image thereon is passed through a nip between the heat roller and the press roller and has the toner image fixed thereon by heat and pressure. A heater for heating the heat roller has customarily been implemented by a halogen heater using a halogen lamp.

A current trend in the imaging art is toward a power saving type of image forming apparatus constructed to shut off power supply to a heater when the apparatus is not used from the environment standpoint. In this type of image forming apparatus, it is necessary for the heater to immediately raise the surface temperature of a heat roller to preselected temperature at the time of image formation. In practice, however, power is applied from a commercial power supply to one or more heaters, so that power available for the individual heater is limited. Moreover, a certain period of time is necessary for a halogen heater to heat the heat roller to the preselected temperature.

In light of the above, it has been customary with a fixing device of the type using a halogen heater to reduce the wall thickness of a heat roller to 1 mm or below. Such a small wall thickness is successful to reduce the thermal capacity of the heat roller and therefore to sharply heat the heat roller to preselected temperature. The small wall thickness, however, brings about the following problems. A heat roller with a thin wall lacks mechanical strength and is therefore apt to collapse, warp or otherwise deform. Further, as the wall thickness of the heat roller decreases, machining becomes technically more difficult to practice and requires higher accuracy, resulting in an increase in cost.

To solve the problems stated above, there has been proposed a fixing device configured to apply power greater than power available with a commercial power supply to a heater, thereby accelerating the warm-up of a heat roller. This is contrastive to the above-stated scheme that reduces the thermal capacity of a heat roller in order to reduce power consumption losses. Japanese Patent Laid-Open Publication No. 3-36579, for example, discloses a heating device for a fixing device that includes a heater configured to generate heat on receiving power via heater drive means. The heater drive means includes a rechargeable battery and a charger connected to a commercial power supply for charging the battery. The heater is made up of a main heater receiving power from the commercial power supply and an auxiliary heater receiving power from the battery. The battery is selectively connectable to the charger to form a charge circuit or connectable to the auxiliary heater to form a discharge circuit. The discharge circuit serves to reduce the warm-up time of the heater.

Japanese Utility Model Laid-Open Publication No. 63-150967 teaches a fixing device including heating means implemented as a first heater powered by an AC power supply and a second heater powered by a battery rechargeable by charging means.

Japanese Patent Laid-Open Publication No. 3-5779 discloses an image forming apparatus including a thermal fixing device in which a heat roller accommodates a main heater and a subheater therein. More specifically, the apparatus taught in this document includes a main power supply for heating the main heater, first switching means for selectively turning on or turning off the main power supply, a battery for heating the subheater, charging means for charging the battery, second switching means for selectively connecting the battery to the subheater or the charging means, temperature sensing means responsive to the temperature of the heat roller, and control means for controlling the first and second switching means in accordance with the output of the temperature sensing means. When the temperature of the heat roller being heated by the main power supply drops to reference temperature related to a fixing ability, the subheater is heated via the battery. When the temperature of the heat roller rises above the reference temperature, the heating of the subheater is interrupted.

Japanese Patent Laid-Open Publication No. 2000-315567 proposes a heating device including a heating section and a main and an auxiliary power supply unit. The heating section includes a heat generating body to be applied with power from the main and auxiliary power supply units. The auxiliary power supply unit is implemented by a capacitor.

Japanese Patent Laid-Open Publication No. 2000-98799 discloses a heating device for a fixing device that includes a heater for generating heat when applied with power and heater drive means for feeding power to the heater. The heater drive means includes a rechargeable battery and a charger for charging the battery by being applied with power from a commercial power supply. The heater is made up of a main heater powered by the commercial power supply and an auxiliary heater powered by the battery. The battery is charged when the main heater is turned off.

The precondition with any one of the conventional heating devices, fixing devices and image forming apparatuses discussed above is that the capacitor, rechargeable battery or similar auxiliary power supply can store electric energy great enough to implement rapid warm-up. Despite that such a precondition involves risks as to user's safety, no safety measures have been taken with the conventional devices as to troubles ascribable to the auxiliary power supply. Particularly, when the image forming apparatus enters a non-use mode with great energy remaining in the auxiliary power supply, dangers unexpected with the conventional image forming apparatus are apt to occur. The non-use mode mentioned above refers to a condition wherein the apparatus is transported for disposal or maintained by way of example.

SUMMARY OF THE INVENTION

It is an object of the present invention to provide an image forming apparatus capable not only of reducing a warm-up time but also of protecting the user from dangers ascribable to the troubles of a storage or auxiliary power supply when the apparatus is in a non-use mode.

An image forming apparatus of the present invention includes a fixing device for fixing a toner image formed on a recording medium. A heat source is applied with power for generating heat to thereby heating the heating device. A drive circuit includes a storage capable of being selectively charged or discharged and a charger for charging the storage by being supplied with power from a commercial power supply. A discharging device discharges the storage in a non-use mode in which the apparatus is not used.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
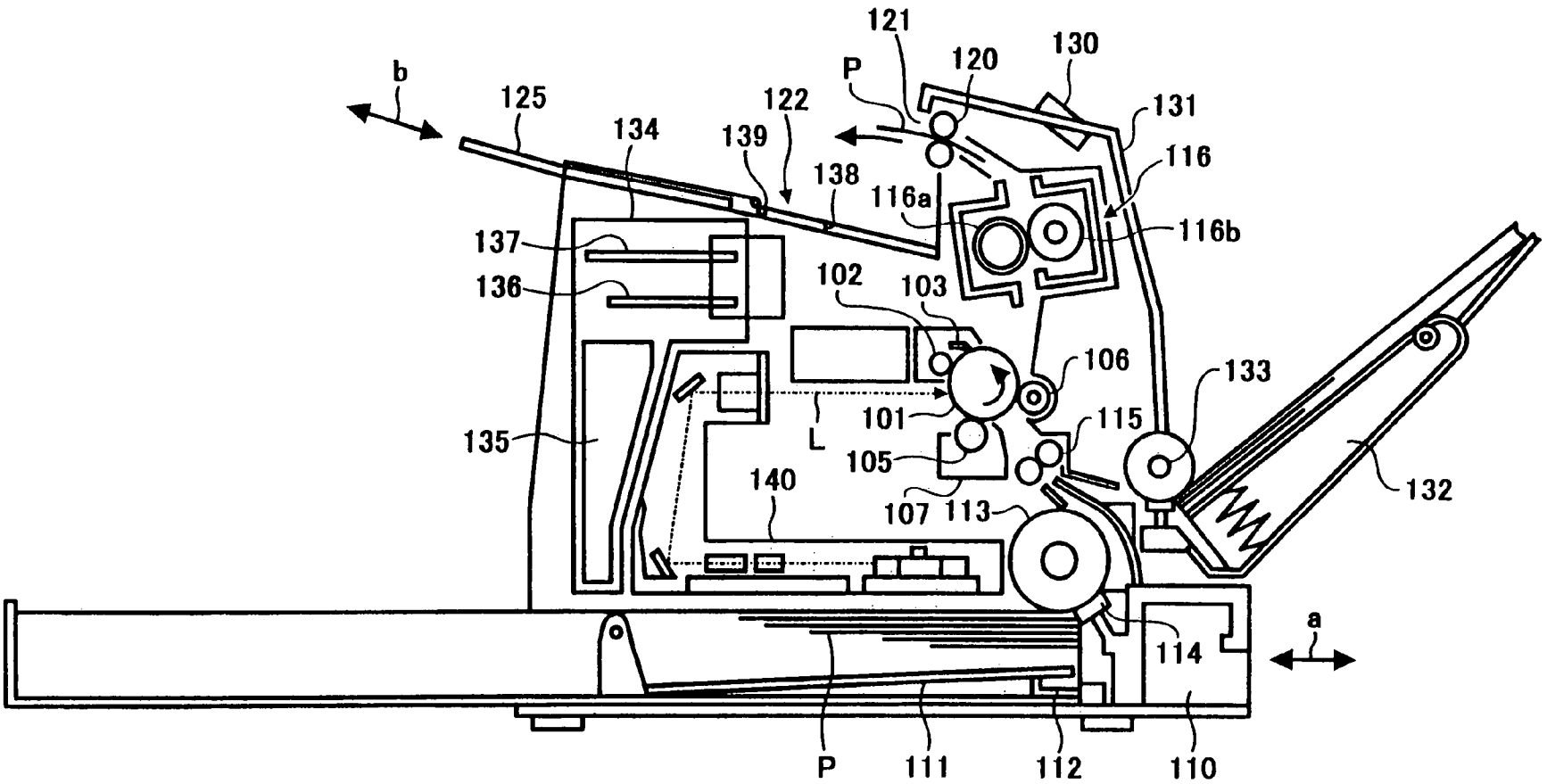
FIG. 1 is a view showing the general construction of an image forming apparatus in accordance with the present invention.

Referring to FIG. 1 of the drawings, the general construction of an image forming apparatus in accordance with the present invention is shown. As shown, the image forming apparatus includes an image carrier implemented as a photoconductive drum 101. Arranged around the drum 101 are charging means 102, cleaning means 103, a developing device 107, and image transferring means 106. The developing device 107 includes a developing sleeve or developing means 105 for developing a latent image formed on the drum 101 with toner.

While a drive source, not shown, causes the drum 101 to rotate in a direction indicated by an arrow in FIG. 1, the charging means 102 uniformly charges the surface of the drum 101. Laser optics or writing means 140 scans the charged surface of the drum 101 with a laser beam L in accordance with image data to thereby form a latent image on the drum 101. The developing device 107 develops the latent image with toner to thereby produce a corresponding toner image. The toner image is transferred from the drum 101 to a sheet or recording medium P, as will be described in detail later. After the image transfer, the cleaning means 103 cleans the surface of the drum 101. In this sense, the charging means 102, laser optics 140 and developing device 107 constitute image forming means for forming a toner image on the drum 101.

A sheet feeder is positioned in the lower portion of the apparatus and includes a sheet cassette 110, which is removable in a direction indicated by an arrow a in FIG. 1. The sheet cassette 110 includes a bottom plate 111 loaded with a stack of sheets P. A spring, not shown, presses the top of the sheet stack P against a pickup roller 113 via an arm 112 and the bottom plate 111. When the pickup roller 113 is rotated by a command output from a controller, not shown, the pickup roller 113 pays out the top sheet P from the sheet cassette 110 toward a registration roller pair 115. At this instant, a pad 114 prevents the sheet or sheets underlying the top sheet P from being paid out together with the top sheet P.

A control panel 130 protrudes from the top front portion (top right portion in FIG. 1) of a casing 131. A sheet tray 132 is angularly movably mounted to the casing 131 via a pin 133 and loaded with a stack of sheets. A pickup roller pays out the top sheet from the sheet tray 132 toward the registration roller pair 115 while a pad separates the top sheet being paid out from the underlying sheets. The operator of the apparatus is expected to select either one of the sheet cassette 110 and sheet tray 132.

The registration roller pair 115 stops the sheet P reached it and then starts conveying the sheet P toward the image transferring means 106 at such a timing that the leading edge of the sheet P meets the leading edge of the toner image formed on the drum 101. The image transferring means 106 transfers the toner image from the drum 101 to the sheet P. The sheet P with the toner image is conveyed to a fixing device 116. In the illustrative embodiment, the fixing unit 116 includes a heat roller or heating member **116*a* and a press roller or pressing member 116*b* pressed against the heat roller 116*a*. When the sheet P is conveyed via the nip between the heat roller 116*a* and the press roller 116*b*, the toner image is fixed on the sheet P by heat and pressure. The heat roller 116*a*** may be replaced with a belt, if desired.

The sheet P coming out of the fixing device 116 is driven out from the casing 131 to a print tray 122 via an outlet 121 face down, i.e., with the image surface facing downward. A print stopper 125 is slidable in a direction indicated by an arrow b in FIG. 1 so as to cope with various sizes of sheets to be driven out via the outlet 121. A box 134 is positioned in the left portion of the apparatus, as viewed in FIG. 1, and accommodates power supply circuitry 135, a printed circuit board (engine driver board) 136, a controller board 137 and other electric control devices. A cover 138, which constitutes the print tray 122, is angularly movable, or openable, about a fulcrum 139.

Figure 2:
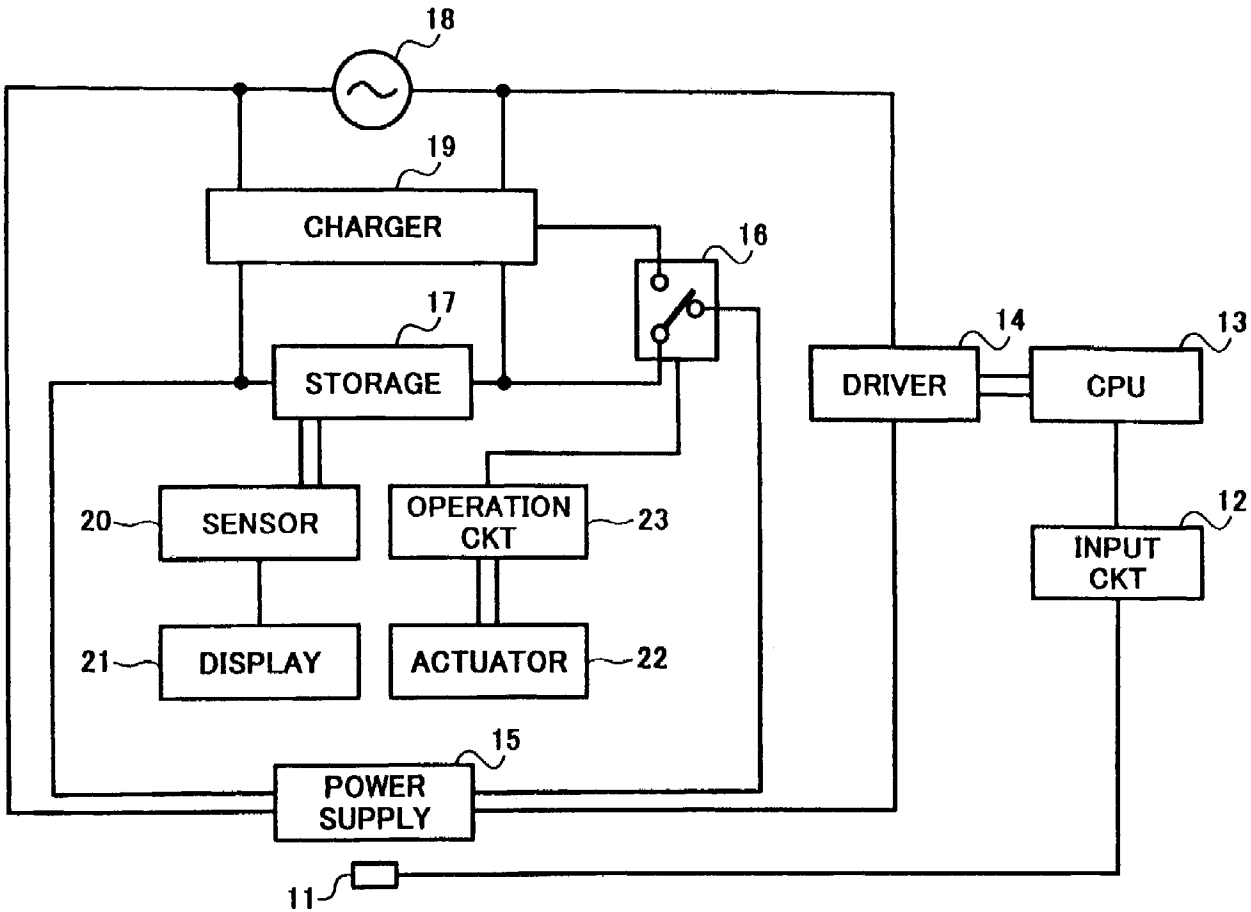
FIG. 2 is a block diagram showing a first embodiment of the fixing device included in the apparatus of FIG. 1.

Reference will be made to FIG. 2 for describing a first embodiment of the fixing device 116 in accordance with the present invention. As shown, the fixing device includes a temperature sensor 11 responsive to the surface temperature or fixing temperature of the heat roller **116*a*, FIG. 1. The output of the temperature sensor 11 is sent to a CPU (Central Processing Unit) or control means 13 via an input circuit 12. The CPU 13 controls, based on the sensed temperature, current supply to a heat source 15 via a driver 14 such that the surface temperature of the heat roller 116*a* remains at preselected temperature. Also, the CPU 13 controls current supply from a storage 17 to the heat source 15 via a switch 16. The heat source 15, used to heat the heat roller 116*a*, maybe implemented as a heater accommodated in the roller 116*a***.

More specifically, the heat source 15 is connected to a commercial power supply 18 via the driver 14. The driver 14C controls current supply from the commercial power supply 18 to the heat source 15 under the control of the CPU 13. The CPU 13 selectively connects the storage 17 to a charger 19 or the heat source 15 in accordance with whether the fixing device 116 is in a stand-by state or whether it is in operation. The storage 17 should preferably have sharp response and may therefore advantageously be implemented as, e.g., a capacitor with a rapid charging and discharging capability.

When the fixing device 116 is in a stand-by state, the CPU 13 connects the storage 17 to the charger 19 via the switch 14. In this condition, the charger 19 converts the AC power of the commercial power supply 18 to DC power and applies the DC power to the storage 17, thereby charging the storage 17. On the other hand, when the fixing device 116 is in operation, the CPU 13 connects the storage 17 to the heat source 15 with the result that the charge stored in the charger 17 is released to the heat source 15. Consequently, the heat source 15 is driven by a DC current.

In the above configuration, when the fixing device 116 needs great power within a short period of time, e.g., on the start-up of the apparatus, the heat source 15 is driven by both an AC current fed from the commercial power supply 18 via the driver 14 and the DC current fed from the storage 17. As a result, the surface temperature of the heat roller 116*a* is sharply raised to the preselected temperature. In the other conditions, the CPU 13 controls the current supply from the commercial power supply 18 to the heat source 15 such that the surface temperature of the heat roller 116*a* remains at the preselected temperature.

A sensor 20 measures energy remaining in the storage 17 and sends a signal representative of the measured residual energy to a display 21, which may be positioned on the control panel 130, FIG. 1. When the charge stored in the storage 17 is being discharged, the display 21 displays the residual energy of the storage 17 in a plurality of steps. If the energy remaining in the storage 17 is above a preselected level, then the display 21 displays an alarm message thereon before the apparatus enters a non-use mode. The non-use mode refers to., e.g., a mode wherein a main power supply included in the apparatus is turned off over a long period of time or a mode wherein the main power supply is turned off for the transport or the maintenance of the apparatus. The main power supply includes a power switch for feeding the power of the commercial power supply 18 to the various sections of the apparatus.

The alarm message appearing on the display 21 shows the user that the energy remaining in the storage 17 must be discharged for the safety purpose. For example, the alarm message may urge the user to touch a button, switch or similar actuator 22, so that the actuator 22 forcibly causes, via an operation circuit 23, the switch 16 to connect the storage 17 to the heat source 15, thereby forcibly releasing the residual energy of the storage 17 to the heat source 15. More specifically, when the user, noticed the alarm message, touches the actuator 22, the actuator 22 commands, via the operation circuit 22, the switch 16 to construct a discharge circuit for releasing the energy of the storage 17 to the heat source 15. Only when the switch 16 is so forced to connect the storage 17 to the heat source 15 by the actuator 22, the switch 17 is brought out of control of the CPU 13.

As stated above, in the illustrative embodiment, power is fed to the heat source 15 from both of the commercial power supply 18 and storage 17, reducing a period of time necessary for the fixing device 116 to be warmed up to the preselected temperature. Energy left in the storage 17 in the non-use mode would bring about dangerous situations. In the illustrative embodiment, in the non-use mode, the actuator 22 and operation circuit 23, or discharging means, allow electric energy remaining in the storage 17 to be transformed to another kind of energy and consumed. This successfully protects the user from dangers ascribable to the troubles of the storage 17, which may occur in the non-use mode. If desired, the illustrative embodiment may be modified to effectively use the electric energy remaining in the storage 17 in the non-use mode.

Figure 3:
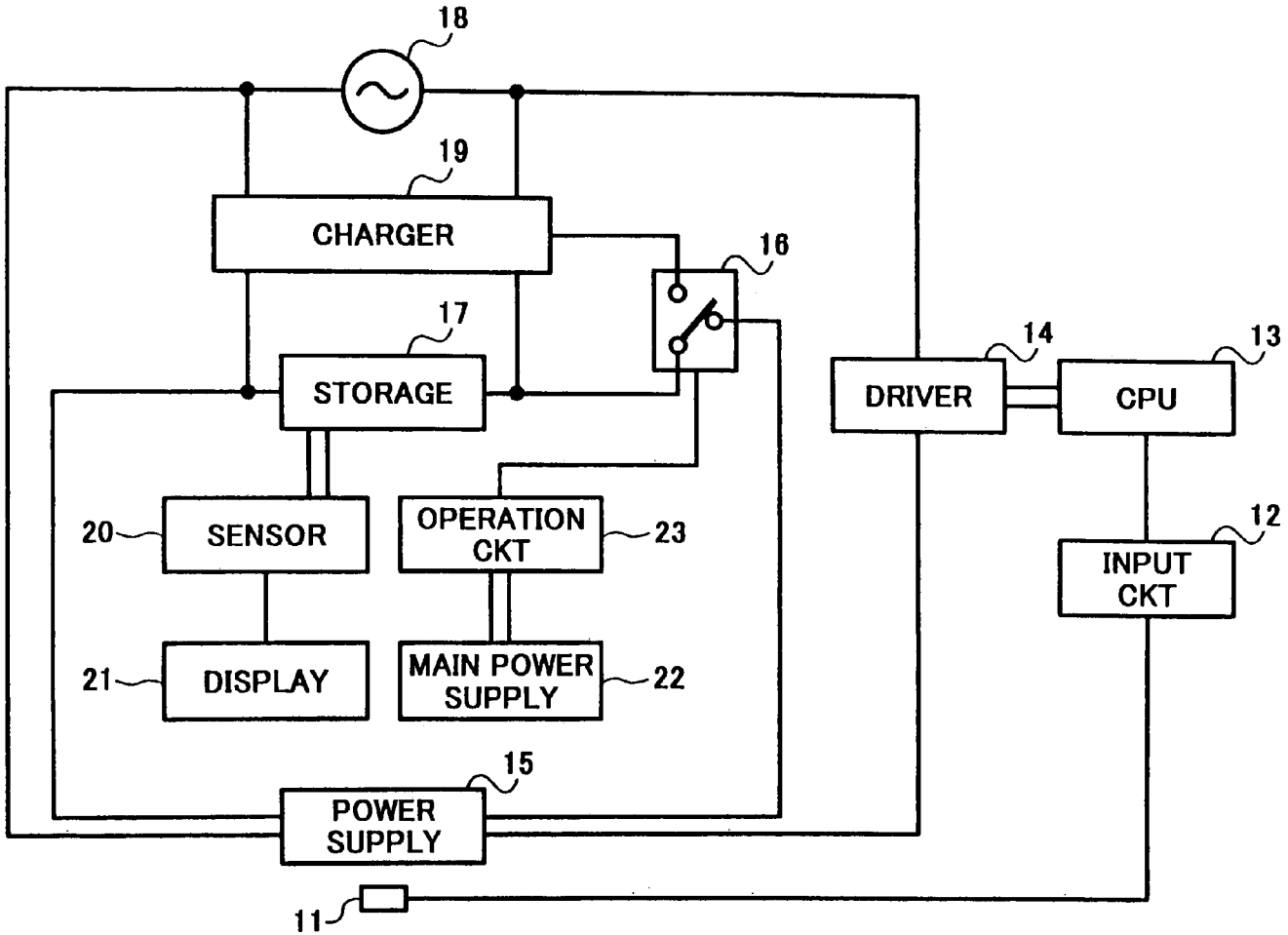
FIG. 3 is a block diagram showing a second embodiment of the fixing device included in the apparatus of FIG. 1.

FIG. 3 shows a second embodiment of the fixing device 116.in accordance with the present invention. As shown, the second embodiment differs from the first embodiment in that a main power supply 24 is substituted for the exclusive actuator 22 for discharge. In the illustrative embodiment, when the main power supply 24 is turned on, the switch 16 is controlled by the CPU 13 in the same manner as in the first embodiment. When the main power supply 24 is turned off, the switch 16 forcibly connects the storage 17 to the heat source 15, thereby releasing energy remaining, if any, in the storage 17 to the heat source 15. This is also successful to insure safety operation.

Further, the first and second embodiments both release energy remaining in the storage 17 to the heat source 15 and therefore do not need extra circuitry for discharging the storage 17.

Figure 4:
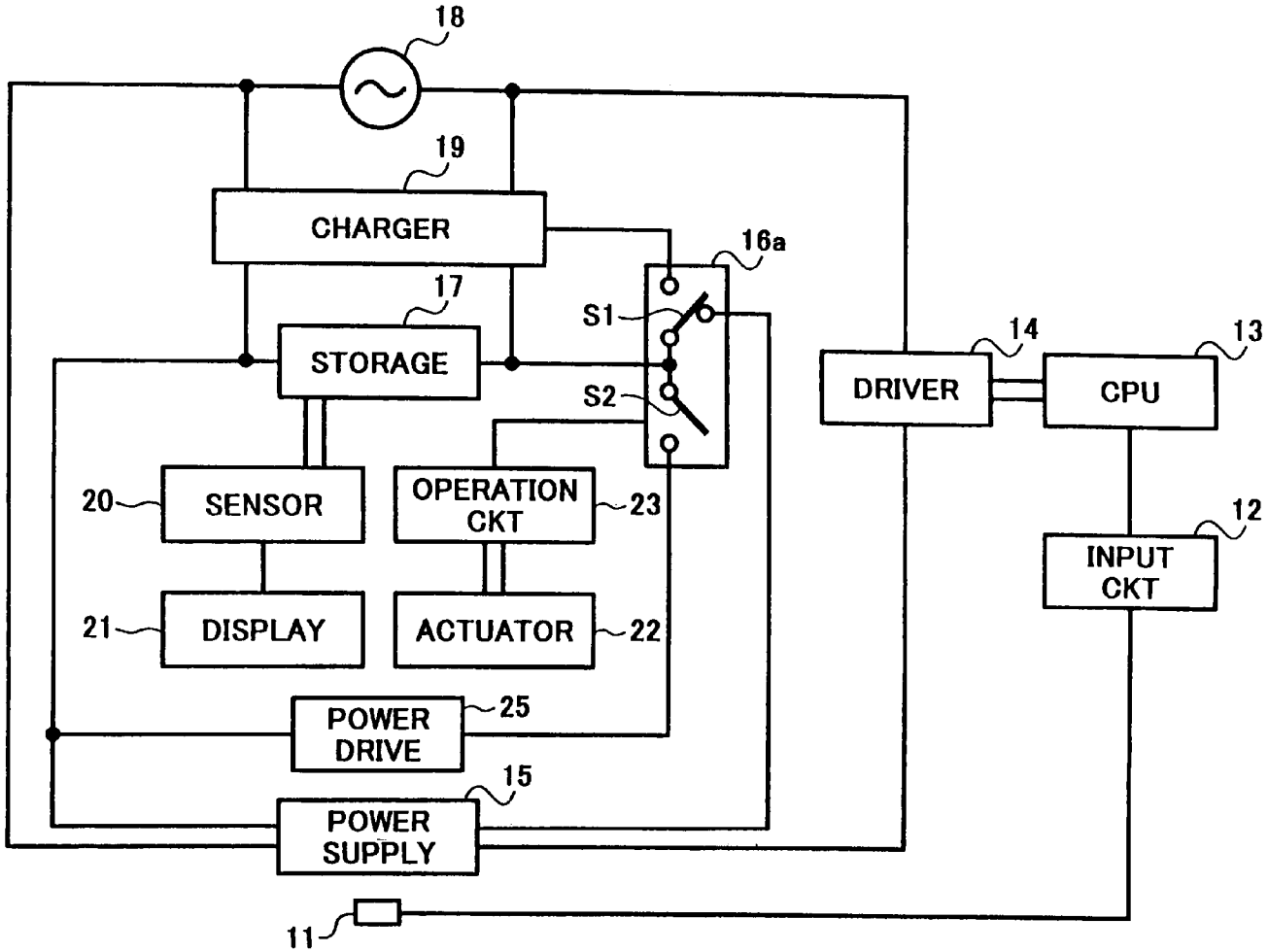
FIG. 4 is a block diagram showing a third embodiment of the fixing device included in the apparatus of FIG. 1.

A fourth embodiment of the fixing device 116 in accordance with the present invention will be described with reference to FIG. 4. As shown, the fourth embodiment includes a switch 16*a* in place of the switch 16 of the first embodiment. The switch 16*a* is made up of first switch portion S1 and a second switch portion S2. The first switch portion S1 selectively connects the storage 17 to the charger 19 or the heat source 15 under the control of the CPU 13 as in the first embodiment. The second switch portion S2 connects the storage 17 to a power drive 25 by being operated by the actuator 22 via the operation circuit 23. More specifically, the switch portion S2 does not connect the storage 17 to the power drive 25 when turned off by the actuator 22 or connects the former to the latter when turned on by the actuator 22. The power drive 25 is representative of any section arranged in the apparatus and driven by electric energy.

When the user, noticed the alarm message on the display 21 before the non-use mode, touches the actuator 22., the actuator 22 causes the second switch portion S2 to connect the storage 17 to the power drive 25 for thereby releasing energy remaining in the storage 17 to the power drive 25. The residual energy of the storage 17 can therefore be released while generating a minimum of heat.

If desired, the illustrative embodiment may be modified such that when the switch portion S2 is turned on by the actuator 22, the switch portion S2 connects the storage 17 to both of the heat source 15 and power drive 25. The power drive 25 may be implemented as a fan that sends air to the heat source 15, in which case the residual energy of the storage 17 can be efficiently discharged while allowing a minimum of temperature elevation to occur inside the apparatus.

Figure 5:
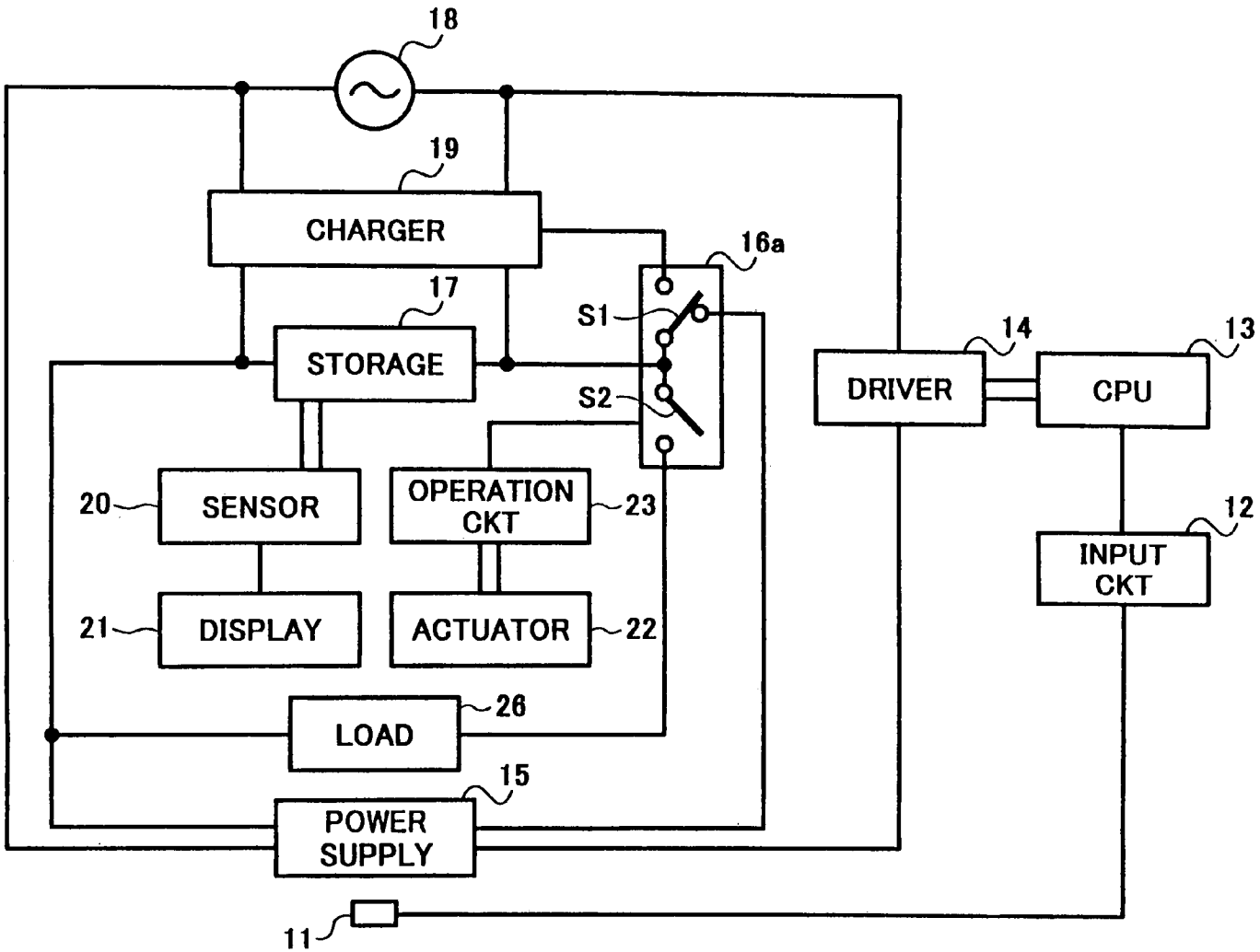
FIG. 5 is a block diagram showing a fourth embodiment of the fixing device included in the apparatus of FIG. 1

FIG. 5 shows a fourth embodiment of the fixing device 116 in accordance with the present invention. As shown, the fourth embodiment is identical with the third embodiment except that a load 26 is substituted for the power drive 25, FIG. 4, and connected to the second switch portion S2 of the switch 16*a*, forming an exclusive discharge circuit for the storage 17. When the user, noticed the alarm message on the display 21 before the non-use mode, touches the actuator 22, the actuator 22 causes the second switch portion S2 to connect the storage 17 to the load 26 for thereby releasing energy remaining in the storage 17 to the power drive 25. The load 26 may have any desired value with respect to the discharge of the storage 17 and can therefore be optimized.

A fifth embodiment to be described hereinafter is a modification of any one of the first to fourth embodiments.

In the fifth embodiment, the storage 17 and discharge circuit along which discharge current flows from the storage 17 are enclosed by an insulating member to such a degree that the user cannot touch them. More specifically, if the storage 17 and discharge circuit are hermetically closed by an insulating member, then the user runs into danger when pressure inside the hermetically closed space rises due to some trouble. It is therefore necessary to space the storage 17 and discharge circuit from the insulating member such that the user's access is inhibited. While the insulating member may be partly openable in consideration of maintenance, the openable part must be lockable in a closed position at least during the discharge of the storage 17. The fifth embodiment therefore protects the user from an electric shock and further enhances safety operation.

A sixth embodiment to be described hereinafter is a modification of any one of the first to fifth embodiments. In the sixth embodiment, the storage 17 is positioned remote from the heat roller 116*a* and press roller 116*b* of the fixing device 116. In addition, the storage 17 is mounted on a tray formed of an insulator. In this configuration, the storage 17 is kept away from heat output from the fixing device 116 and therefore free from troubles ascribable to the heat. In addition, when an electrolyte leaks from the storage 17 in the event of a trouble, the tray prevents the electrolyte from flowing out of the apparatus.

In any one of the first to sixth embodiments, the sensor or sensing means 20 and display or outputting means 21 can alert the user to a trouble that may occur due to energy remaining in the storage 17, thereby protecting the user from danger.

Various modifications will become possible for those skilled in the art after receiving the teachings of the present disclosure without departing from the scope thereof.

What is claimed is:

1. An image forming apparatus comprising:

sensing means for sensing residual energy remaining in a storage; and displaying means for displaying the residual energy of said storage in accordance with an output of said sensing means;

wherein said displaying means displays the residual energy of said storage when said storage is being discharged.

2. An image forming apparatus comprising:

sensing means for sensing residual energy remaining in a storage; and displaying means for displaying the residual energy of said storage in accordance with an output of said sensing means;

wherein said displaying means displays the residual energy of said storage in a plurality of steps in accordance with said output of said storage.

3. An image forming apparatus comprising:

sensing means for sensing residual energy remaining in a storage;

displaying means for displaying the residual energy of said storage in accordance with an output of said sensing means; and outputting means for displaying an alarm message before the apparatus enters a non-use mode in which the apparatus is not used if the residual energy of said storage is above a preselected level.

4. An image forming apparatus comprising:

a sensing device configured to sense residual energy remaining in a storage; and a displaying device configured to display the residual energy of said storage in accordance with an output of said sensing device;

wherein said displaying device displays the residual energy in said storage when said storage is being discharged.

5. An image forming apparatus comprising:

a sensing device configured to sense residual energy remaining in a storage; and a displaying device configured to display the residual energy of said storage in accordance with an output of said sensing device;

wherein said displaying device displays the residual energy of said storage in a plurality of steps in accordance with said output of said storage.

6. An image forming apparatus comprising:

a sensing device configured to sense residual energy remaining in a storage;

a displaying device configured to display the residual energy of said storage in accordance with an output of said sensing device; and an outputting device configured to display an alarm message before the apparatus enters a non-use mode in which the apparatus is not used if the residual energy of said storage is above a preselected level.

7. An image forming apparatus comprising:

a fixing unit including a heat source and configured to fix a toner image formed on a sheet-like recording medium on said recording medium;

a storage configured to be selectively charged or discharged; and a discharging section configured to discharge said storage in a non-use mode in which said image forming apparatus is not used.

8. The apparatus as claimed in claim 7, wherein said discharging section comprises an actuator to be operated by a user for forcibly discharging said storage.

9. The apparatus as claimed in claim 7, wherein said discharging section automatically discharges said storage when a power switch is turned off.

10. The apparatus as claimed in claim 7, wherein said discharging section discharges said storage to said heat source.

11. The apparatus as claimed in claim 7, wherein said discharging section discharges said storage to a fan.

12. The apparatus as claimed in claim 7, wherein said discharging section discharges said storage to an exclusive circuit.

13. The apparatus as claimed in claim 7, wherein said discharging section discharges said storage to a plurality of loads.

14. The apparatus as claimed in claim 7, further comprising:

means for displaying an amount of energy remaining in said storage.

15. In an image forming apparatus comprising:

a fixing unit including a heat source and configured to fix a toner image formed on a sheet-like recording medium on said recording medium; and a storage configured to be selectively charged or discharged, wherein said storage is enclosed within an insulating member.

16. An image forming apparatus comprising:

a fixing unit including a heat source and configured to fix a toner image formed on a sheet-like recording medium on said recording medium;

a storage configured to be selectively charged or discharged; and a charger configured to charge said storage by being supplied with power from a commercial power supply, wherein said storage and said charger are enclosed within an insulating member.

17. An image forming apparatus comprising:

a fixing unit including a heat source and configured to fix a toner image formed on a sheet-like recording medium on said recording medium; and a heat source applied with power for generating heat to thereby heat said fixing device; and a storage configured to be selectively charged or discharged, wherein said storage is mounted on a tray.

18. An image forming apparatus comprising:

a fixing unit including a heat source and configured to fix a toner image formed on a sheet-like recording medium on said recording medium;

a storage configured to be selectively charged or discharged; and a charger configured to charge said storage by being supplied with power from a commercial power supply, wherein said storage and said charger are mounted on a tray.

19. An image forming apparatus comprising:

a fixing unit including a heat source and configured to fix a toner image formed on a sheet-like recording medium on said recording medium; and a storage configured to be selectively charged or discharged, wherein said storage is positioned remote from said fixing device.

* * * * *